US005927497A

United States Patent [19]

Baumgartner et al.

[11] Patent Number: 5,927,497

[45] Date of Patent: Jul. 27, 1999

[54] PACK OF LARGE SURFACE WASHERS

[75] Inventors: Stefan Baumgartner, Altstatten; Daniel Gasser, Diepoldsau; Jurg Maurer, Heerbrugg; Walter Seifert, Buchs, all of Switzerland

[73] Assignee: SFS Industrie Holding AG, Heerbrugg, Switzerland

[21] Appl. No.: 08/875,959

[22] PCT Filed: Feb. 9, 1996

[86] PCT No.: PCT/EP96/00535

§ 371 Date: Oct. 7, 1997

§ 102(e) Date: Oct. 7, 1997

[87] PCT Pub. No.: WO96/25345

PCT Pub. Date: Aug. 22, 1996

[30] Foreign Application Priority Data

Feb. 17, 1995 [DE] Germany ..... 195 05 468

[51] Int. Cl.[6] ..... B65D 73/00; B65D 85/62

[52] U.S. Cl. ..... 206/493; 206/499; 206/526; 294/158

[58] Field of Search ..... 206/303, 499, 206/493, 445, 526; 294/158

[56] References Cited

U.S. PATENT DOCUMENTS

| | | | |
|---|---|---|---|
| 1,560,938 | 11/1925 | Lund | 294/158 |
| 1,562,196 | 11/1925 | Abrams | 294/158 |
| 3,180,489 | 4/1965 | McGinn . | |
| 4,514,126 | 4/1985 | Knowles | 206/499 X |
| 5,139,144 | 8/1992 | Robert, Jr. | 206/493 X |
| 5,163,580 | 11/1992 | Beach et al. . | |

FOREIGN PATENT DOCUMENTS

| | | | |
|---|---|---|---|
| 1382299 | 11/1969 | France | 206/493 |
| 2 198 468 | 3/1994 | France . | |
| 673 306 | 2/1990 | Switzerland . | |
| 390113 | 3/1933 | United Kingdom | 206/493 |
| WO84/03874 | 10/1984 | WIPO . | |

*Primary Examiner*—Byron P. Gehman
*Attorney, Agent, or Firm*—Helfgott & Karas, PC

[57] ABSTRACT

In a pack of substantially parallel-stacked transportable washers, at least two through-holes are provided in each washer, the two legs of a substantially U-shaped metal or plastic wire being positioned in the two through-holes of the stack of washers. The free ends of the legs projecting beyond the stack are bent over to positions oriented at approximately right angles to the respective legs. By appropriate force on the crosspiece, or on an extension, the wire is pulled back out of the stack of washers, the free ends being restraightened in the process.

9 Claims, 1 Drawing Sheet

PACK OF LARGE SURFACE WASHERS

BACKGROUND OF THE INVENTION

The invention relates to a pack of large surface washers. Such a pack is known from WO 84/03874, to which more detailed reference will be made hereinafter.

Large-surface washers must be kept in a certain order for storage and transportation, and it is desired in particular that this order be maintained until the washers are loaded into the magazine of a placing (washer applying) machine. Stacking problems occur in particular with spacing elements, with reinforcing ribs or with spikes projecting from the underside.

If such stacks of large-surface washers are packed in a cardboard box, for example, advantages are certainly obtained for storage and transportation, but disadvantages result with respect to the necessary loading into a magazine. In practice, loading is limited to what can be grasped by hand, meaning individual washers or a small stack thereof. Even if such stacks of large-surface washers are bound together with adhesive tape, for example, to form a pack, the adhesive tape must be removed beforehand in order that the washers can be loaded into the magazine.

From U.S. Pat. No. 5,163,580 there is known a pack for a washer stack held together by a plastic tape passed through a through-hole provided in all washers. At the ends of the stack the plastic tape is doubled back and heat-sealed to itself, thus forming a kind of knot that is larger than the through-holes in the washers, in order thereby to hold these together. After the washers have been loaded into the magazine, the plastic tape is pulled vigorously enough to deform one heat-sealed end of the tape sufficiently to slip through the through-holes in the washers.

However, the size of the end of the tape must be sufficiently matched to the size of the through-holes in the washers to ensure that the stack is held together, while still allowing the tape to be pulled out of the stack.

To remove the hardware from the stack, the plastic rods are pulled out or cut off in successive steps. In the process, however, it is sometimes necessary to remove fragments of plastic rods remaining in the through-holes, which is time-consuming.

SUMMARY OF THE INVENTION

The object of the invention is to improve a pack of stacked washers such that a stack of washers can be packed as simply and rapidly as possible for storage and transportation. At the same time the stacked washers are mutually locked against turning, and the pack can be rapidly removed again during loading of the stack into the magazine of a placing machine.

In a pack of substantially parallel-stacked transportable washers, at least two through-holes are provided in each washer, the two legs of a substantially U-shaped metal or plastic wire being positioned in the two through-holes of the stack of washers. The free ends of the legs projecting beyond the stack are bent over to positions oriented at approximately right angles to the respective legs. By appropriate force on the crosspiece, or on an extension, the wire is pulled back out of the stack of washers, the free ends being restraightened in the process.

By virtue of the features according to the invention, an appropriate stack of large-surface washers is firmly held together, at the same time ensuring that the stacked washers are mutually locked against turning. Such a washer stack can be loaded in a simple manner as a self-contained pack into the magazine of a placing machine. No problems of any kind occur during loading. As soon as the pack containing the stack of large-surface washers has been loaded into the magazine the U-shaped metal or plastic wire can be pulled upward by a very simple tool such as a screwdriver or pliers, so that the ends of its legs, bent over at acute to right angles, are straightened out, and the entire wire can be pulled out of the through-holes of the washers.

Thus cardboard boxes, adhesive tapes, etc. are not required for packing individual stacks of washers, but merely a U-shaped metal or plastic wire, which can be easily disposed of, is needed.

Of course, it must be ensured that the ends of the legs bent over at acute to right angles have sufficient resisting force that they cannot be restraightened by the weight of the washers alone.

Conceivably, for example, the wire may even be a spring-steel wire. In such an embodiment, the bent-over ends of the legs straighten out elastically when appropriate tension was applied to the wire. Thus, the wire can be pulled out of the stack as soon as it has been loaded into an appropriate magazine of a placing machine.

Within the scope of the invention, the ends of two legs of the wire may be introduced into two through-holes provided in the washers at a certain distance on both sides of a central through-hole for accommodating a fastening means. Thus two through-holes positioned at a relatively large distance apart are provided for insertion of the wire, wherewith the locking of the stacked washers against turning is also further improved. Naturally through-holes specifically shaped for this pack can be provide here, or through-holes can be used that are already present in the washers as a result of various punching operations.

One advantageous embodiment provides that the wire comprises two separate segments, which are firmly joined together in the region of a crosspiece joining the two legs. In such an embodiment, for example, the ends of the legs may already be in bent-over position. In such a construction each region of the segment forming the leg and part of the crosspiece will be introduced from below through the through-holes of a washer stack. Thereafter the ends of the two segments opposite the bent-over ends will be firmly joined together. This could be advantageous for assembly reasons in preparing the pack.

In this connection it is expedient for the ends of the segments of the wire facing each other to be heat-sealed or bonded to each other or to be joined to each other by twisting or crimping in the region of the crosspiece, or forming an extension protruding from the crosspiece. Several alternatives are conceivable here, depending on whether the two segments are joined together before or only after insertion into the washer stack.

Precisely when the ends of the two segments of the wire form in their joint region an extension protruding from the crosspiece, it proves to be advantageous for the extension to be bent over into a position perpendicular to the plane of the wire and thus approximately parallel to the plane of the washers. Thus the extension is not a hindrance during storage and transportation or even during loading into the magazine of a placing machine, and can very easily be straightened again when it is necessary to pull the wire out of the stack, for example by grasping this extension.

BRIEF DESCRIPTION OF THE DRAWINGS

Practical examples of the invention will be explained in more detail in the following description by referring to the drawing, wherein.

DESCRIPTION OF PREFERRED EMBODIMENTS

Figure 2:
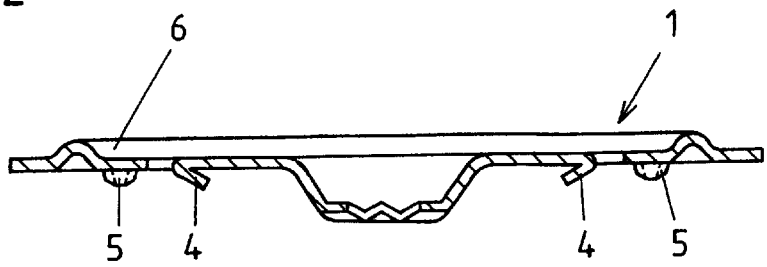
FIG. 2 shows a section through a washer and FIG. 3 shows a top view of such a washer.

A large-surface washer 1 is usually provided with a central through-hole 3 to accommodate a fastening means such as a screw. In addition, reinforcing ribs 6 of some kind are provided, which project upward or downward from the plane of the washer 1.

In order to achieve a better hold with the parts to be fastened under the washer 1, especially for fastening of roofing strips, downwardly directed spike-like or stud-like projections 5 are provided. When such projections 5 are present, it is expedient to provide appropriate spacers 4, which ensure mutual spacing between the stacked washers 1, so that the projections 5 cannot dig into the adjacent washer. A design with spacers 4 is appropriate if the washers 1 are to be fed individually from a stack in a placing machine to the final placement position. By forming spacers 4, through-holes 2 disposed at a distance from both sides of the central through-hole 3 for accommodating the fastening means, are automatically obtained during an appropriate punching process.

Figure 3:
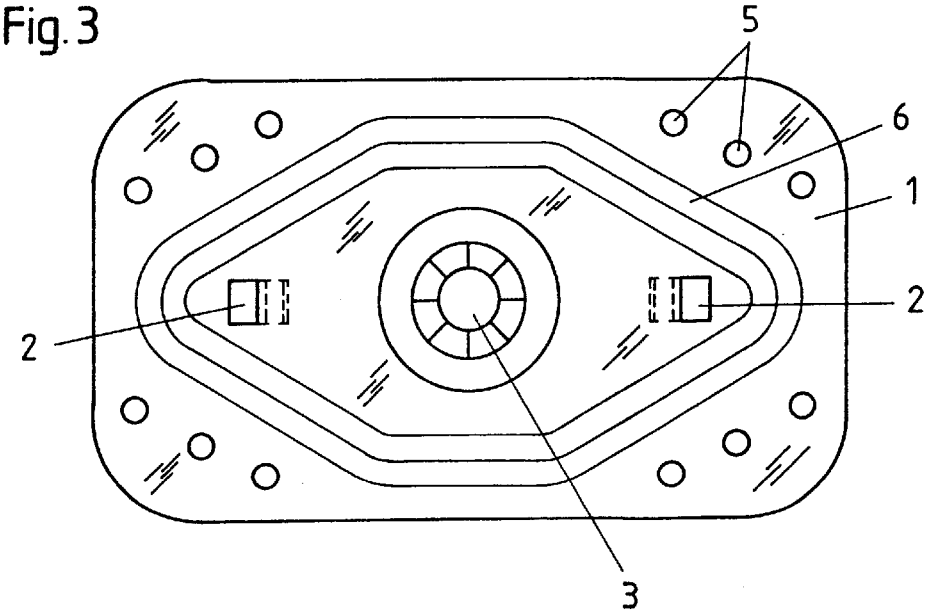

The pack explained hereinafter is naturally suitable for any kind of large-surface washer. Thus the structural features for a washer 1 as illustrated in FIGS. 1 to 3 and descried hereinabove are in no way to be regarded as necessary design features.

To form a pack of parallel-stacked transportable washers 1, there is provided a substantially U-shaped metal or plastic wire 9, the two legs 7',7" of the U-shape are inserted into the two through-holes 2 of the stack of washers 1. Free ends 8' of the legs 7', 7" projecting beyond the stack are bent over at acute to right angles to a position 8. The entire stack of large-surface washers 1 is thereby clamped between a crosspiece 7 joining the legs 7' and 7" and the ends 8' of the two legs 7', 7" bent over into position 8. In this way the stacked washers 1 are on the whole effectively held in place, and the individual washers 1 also cannot turn relative to each other, since the wire 9 engages with the legs 7',7" in two through-holes 2 that are positioned at a relatively large distance from each other.

In an alternative embodiment (not shown), only one through-hole 2 is provided. In which case, a through-hole 2 and the through-hole 3 for accommodating the fastening means will also be used to insert the wire 9. To achieve better stability of the pack, however, it is more expedient to provide two through-holes 2 spaced relatively far apart.

Figure 1:
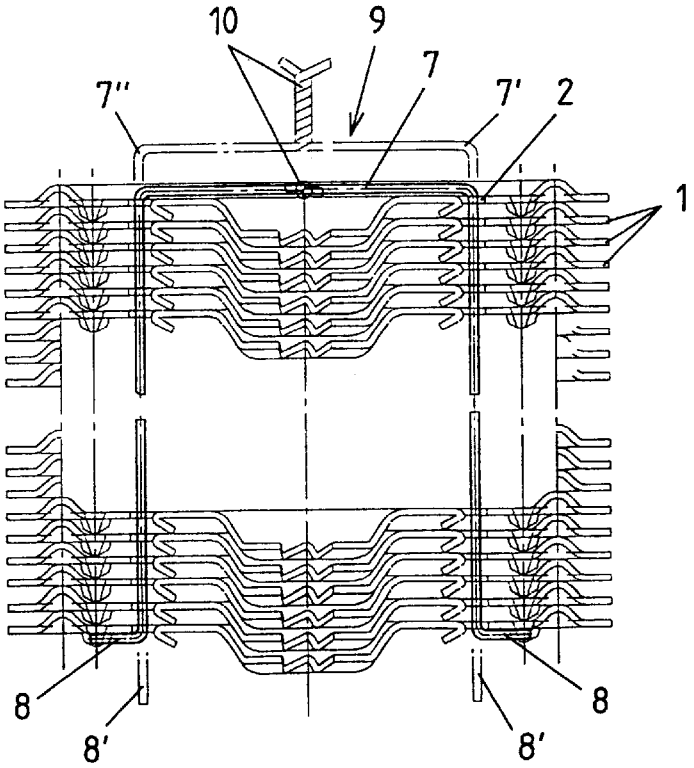
FIG. 1 shows a side view of a stack of large-surface washers, shown in partial cutaway view.

As illustrated in FIG. 1, the wire 9 can also be formed from two separate segments, which are firmly joined together in the region of the crosspiece 7. In the illustrated embodiment, the ends of the two segments facing each other have been twisted together, thus forming an extension 10 protruding from the crosspiece 7. Such a structural arrangement offers the option that the two segments can be prefabricated with the ends 8' bent over into position 8, and—referring to the diagram in FIG. 1, can be inserted from below into the stack, after which the two upwardly projecting ends are bent over and twisted together to form the extension 10.

As also illustrated in FIG. 1, the extension 10 formed in this way is bent over into a position perpendicular to the plane of the U-shape of the wire 9 and thus is approximately parallel to the plane of the washers 1 for the purpose of storage and transportation. If the wire 9 is to be removed after the stack has been loaded in final position in a magazine (not shown), the extension 10 can be bent back up again and grasped, for example, with pliers.

To loosen the pack, or in other words to pull out the wire 9, it is of course also possible to insert a suitable tool such as a screwdriver by force between the crosspiece 7 and the top washer 1 of the stack. By means of the resulting lever action while the crosspiece 7 is being raised, the free ends 8' are straightened to their original position in line with the legs 7', 7", and so the entire wire 9 can be pulled out of the through-holes 2 of the stack.

To join two segments in order to form the wire 9, it is also conceivable to heat-seal or bond the corresponding two ends to each other or to make the joint by a crimping process in the region of the crosspiece 7 or even by forming an extension 10 protruding from the crosspiece 7. For example, a sleeve could even be slipped over the two bent-over ends and a joint made by caulking or crimping.

Another alternative embodiment may provide a kind of extension 10 even when the wire 9 is of one-piece construction. In this case, an appropriate part would be provided precisely for the purpose of applying force for pulling the wire 9 out of the stack. An appropriate loop, for example, could then also be provided in the region of the extension 10, so that a finger, for example, could be inserted in order to pull out the wire 9.

As already explained, the metal or plastic wire 9 or the two segments forming a special embodiment of the wire 9 can be of spring steel instead of non-spring metal or plastic, in which case the free ends 8' would then be restraightened elastically to the original position precisely by exerting an appropriate pulling force on the wire 9.

The configuration of the large-surface washers 1 merely has to be adapted to the type of pack described here by providing at least two through-holes 2 or 2 and 3, into which the legs 7' and 7" of the U-shaped wire 9 can be inserted. In no case do the through-holes 2 or 2 and 3 have to be aligned with each other in a longitudinal or transverse axis of the washer 1, since it is completely immaterial how the crosspiece 7 is positioned or aligned relative to the central axis of a washer 1.

The type of pack described here is also possible for completely flat washers and for any other structural shape of washers, i.e., even if the washers lie snugly upon each other. By means of the pack described here, therefore, a particularly effective and handily advantageous pack of large-surface washers is possible, for which purpose only two through-holes 2, or respectively 2 and 3, spaced apart must be provided in each washer.

In this connection it is also possible for one or both through-holes 2, or 2 and 3, to be formed by two open slots or indentations at the edge of the washer 1. In such a case it must be ensured that the legs 7', 7" of the wire 9 running over the length of the stack cannot turn transversely with respect to its longitudinal direction. Thus it is then necessary at least to secure the free ends 8' of the legs 7', 7" in the bent-over position 8 against turning, which can be achieved, for example, by appropriate knobs, spikes, projections 5 or similar means.

The type of pack described here is also suitable for automated packing of large-surface washers 1, in which case, for example, the free ends 8' of the legs 7', 7" can be pointed or provided with an appropriate ball-headed rounding for a better insertion process. The pack can be loosened very simply on the jobsite, since it is merely necessary to pry a simple tool such as a screwdriver under the crosspiece 7 and make the free ends 8' spring back or bend back to original shape in line with the legs 7', 7". The resisting force of the ends 8' bent over into position 8 only has to be large enough so that washers 1 are not lost during transportation and handling before being fed to a placing machine.

Another advantage is that the stack of washers 1 can still be made to undergo slight lateral movements despite the arrangement of the wire 9. Consequently the stack can be loaded very easily into the magazine of a placing (installation) machine.

We claim:

1. A pack of washers, comprising:

a plurality of parallel-stacked washers, each washer having at least two through-holes;

a U-shaped retainer, the U-shape being defined by a crosspiece having opposite ends and a pair of legs, one said leg extending from each said end of said crosspiece, said legs extending through respective ones of said through-holes in said stacked washers, free ends of said legs extending beyond said stacked washers and each free end being reversibly bent at an angle transverse to a length of the associated leg in its through-hole, said retainer being withdrawn from said through-holes of said washers by a pulling force acting on said crosspiece in a direction away from said washers to unbend said legs at said free ends.

2. A pack of washers as in claim 1, wherein said retainer is a wire.

3. A pack of washers as in claim 2, wherein said retainer wire is spring steel.

4. A pack of washers as in claim 1, wherein said washers further include a central hole located between said two through-holes, said through-holes each being at a preselected distance from said central hole.

5. A pack of washers as in claim 1, wherein said crosspiece is two separate pieces joined together by at least one of bonding, crimping, and twisting.

6. A pack of washers as in claim 1, wherein said crosspiece includes an extension away from said washers, said extension providing a location for application of said pulling force for withdrawal of said retainer from said stacked washers.

7. A pack of washers as in claim 6, wherein said extension is at an angle to a plane of said U-shape of said retainer.

8. A pack of washers as in claim 1, wherein said retainer is one of metal and plastic.

9. A pack of washers as in claim 8, wherein said retainer is a wire.

* * * * *